US008087202B2

(12) United States Patent
Ciavolella

(10) Patent No.: US 8,087,202 B2
(45) Date of Patent: Jan. 3, 2012

(54) PRISON REFORM

(76) Inventor: John Ciavolella, West Palm Beach, FL (US)

( * ) Notice: Subject to any disclaimer, the term of this patent is extended or adjusted under 35 U.S.C. 154(b) by 216 days.

(21) Appl. No.: 12/584,455

(22) Filed: Sep. 4, 2009

(65) Prior Publication Data

US 2010/0064603 A1 Mar. 18, 2010

Related U.S. Application Data

(60) Provisional application No. 61/095,130, filed on Sep. 8, 2008.

(51) Int. Cl.
*E04H 3/08* (2006.01)

(52) U.S. Cl. ..... 52/106; 52/174; 52/234

(58) Field of Classification Search ..... 52/106, 52/234, 174

See application file for complete search history.

(56) References Cited

U.S. PATENT DOCUMENTS

| | | | | | |
|---|---|---|---|---|---|
| 26,500 | A | * | 12/1859 | Jacobs | 52/106 |
| 158,966 | A | * | 1/1875 | Mullett | 52/106 |
| 168,455 | A | * | 10/1875 | Cook et al. | 52/106 |
| 344,644 | A | * | 6/1886 | Erb | 52/106 |
| 469,635 | A | * | 2/1892 | Hale | 52/507 |
| 516,450 | A | * | 3/1894 | Salfield et al. | 52/106 |
| 722,780 | A | * | 3/1903 | Weary | 52/106 |
| 722,781 | A | * | 3/1903 | Weary | 52/106 |
| 1,562,811 | A | * | 11/1925 | Tracy | 109/21.5 |
| 1,614,336 | A | * | 1/1927 | Youngblood | 49/17 |
| 1,629,371 | A | * | 5/1927 | Youngblood | 109/21.5 |
| 3,553,911 | A | * | 1/1971 | Morrow | 52/28 |
| 4,669,239 | A | * | 6/1987 | Maggs et al. | 52/106 |
| 4,970,834 | A | * | 11/1990 | Polson | 52/106 |
| 5,026,211 | A | * | 6/1991 | Schellenberg et al. | 405/204 |
| 5,070,661 | A | * | 12/1991 | Lo Guidici | 52/79.1 |
| 5,261,197 | A | * | 11/1993 | Pickle, Sr. | 52/106 |
| 5,353,557 | A | * | 10/1994 | Lerner et al. | 52/106 |
| 5,813,187 | A | * | 9/1998 | Lee | 52/664 |
| 6,330,771 | B1 | * | 12/2001 | Hester, Jr. | 52/234 |
| 6,360,494 | B1 | * | 3/2002 | Emerson | 52/106 |

* cited by examiner

*Primary Examiner* — Robert Canfield

(57) ABSTRACT

The present invention uses a plurality of incarceration units, wherein each of the incarceration units includes an interior cell and an exercise area. The interior cell and the confined exercise area are adjacent to one another and are constructed out of suitable security material, such as concrete or steel. The interior cell includes a shower suitable for bathing. In addition, one of the walls of the interior cell of the incarceration unit includes a door, which leads from the interior cell to the exercise area. An inmate's use of the shower and the door is controlled by the management of the incarceration facility. The exercise area includes at least one exercise equipment. The incarceration unit provides the usual inmate activities of living, eating, exercise, study and conversation in a facility having a lower risk of violence to inmates or guards, and of undesirable activities, such as drug trafficking or riots by the inmates.

20 Claims, 4 Drawing Sheets

TYPICAL MAXIMUM SECURITY CELL PLAN

TYPICAL MEDIUM SECURITY CELL PLAN

TYPICAL MAXIMUM SECURITY CELL PLAN

TYPICAL MAXIMUM CELL FLOOR PLAN

TYPICAL MEDIUM SECURITY CELL PLAN

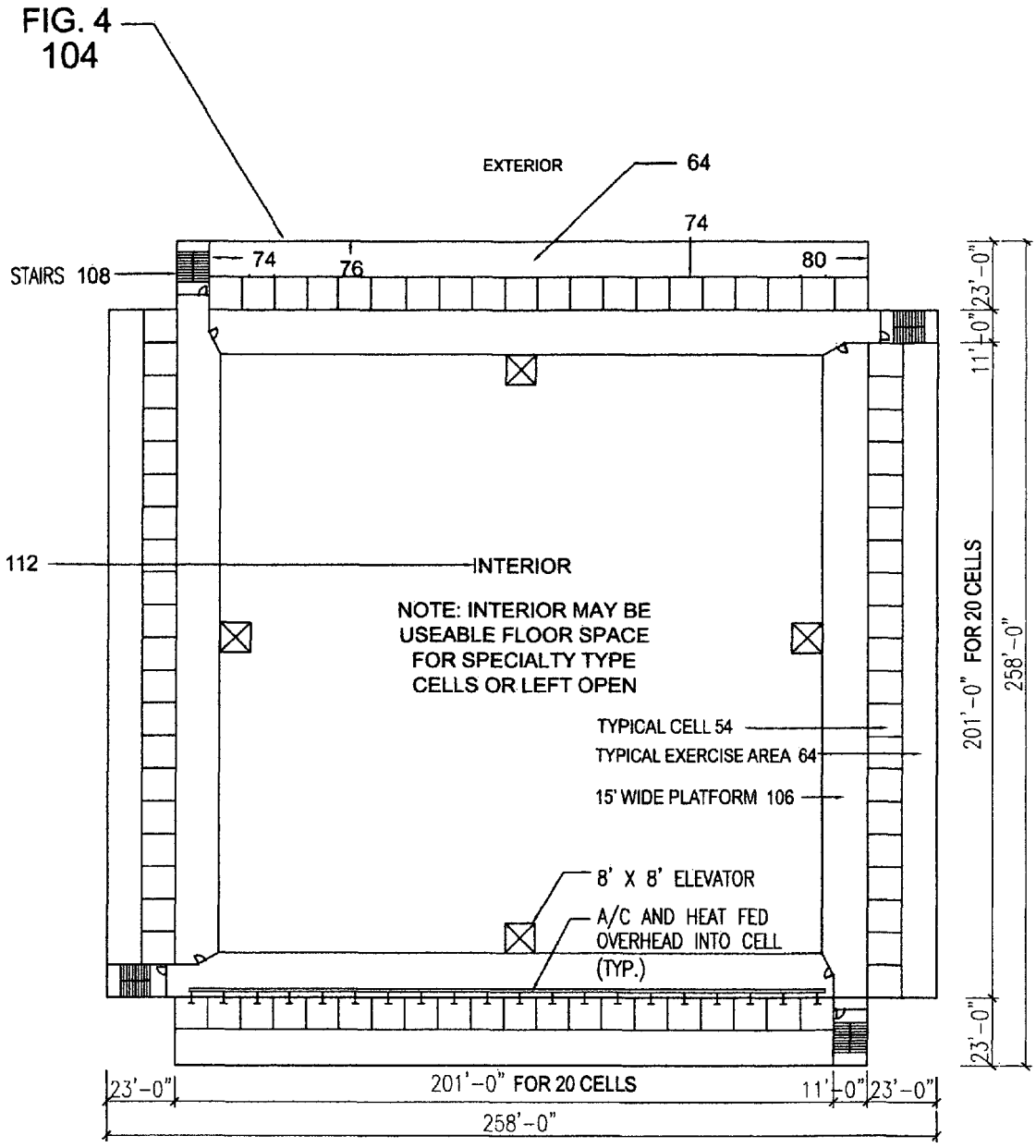
TYPICAL MEDIUM CELL FLOOR PLAN

PRISON REFORM

CROSS-REFERENCE TO RELATED APPLICATION

This application claims priority to the U.S. Provisional Application No. 61/095,130, filed Sep. 8, 2008, the entire contents of which are incorporated herein by reference.

BACKGROUND OF THE INVENTION

1. Field of the Invention

The present invention relates to prison reform. More particularly, this invention relates to prison reform that provides for a system for keeping the inmates and guards separate from one another except in case of emergency. In addition, this invention relates to prison reform that allows an inmate to have a shower, a television monitor, a telephone jack, and access to a room in which to exercise within an incarceration unit, the use of all of which are controlled by incarceration management. Further, this invention relates to prison reform that allows an inmate to have access to a room in which to exercise within an incarceration unit, the use of which is controlled by incarceration management. The present invention thus reduces the need to congregate inmates together for the purposes of bathing, socializing, and exercising.

2. General Background and State of the Art

Systems of incarceration facilities that are used to detain inmates under various circumstances are well known in the art. Many of these prior art systems are incarceration facilities that typically receive criminals who are considered to be an escape risk and dangerous. Accordingly, many of these prior art incarceration facilities typically have sophisticated and expensive security systems and relatively high ratios of guards to inmates. In addition, many of these prior art incarceration facilities typically are constructed in such a manner that utilize a great amount of space and expensive building materials. Further, many of these prior art incarceration facilities typically use expensive techniques in order to supervise the inmates and to prevent the inmates from committing undesirable acts, such as violence, drug trading, and riots during times that the inmates are grouped together. More specifically, many of these prior art incarceration facilities use expensive techniques in order to supervise the inmates and to prevent the inmates from committing undesirable acts during the activities of bathing, socializing, exercising or watching a television monitor or using a telephone. Certainly, in the prior art incarceration facilities, either violence or undesirable acts occur when the inmates are grouped together. Many inmates, under the prior art incarceration facility, suffer brutal attacks by other inmates while grouped together in the traditional exercise yard or bathing facility of an incarceration facility. In addition, guards may suffer violence during the supervision and control of the inmates during which times the inmates are grouped together in the prior art incarceration facilities. Further, use by guards by the prior art incarceration facility during which times the inmates are grouped together comes at considerable expense.

ADVANTAGES OF THE INVENTION

The incarceration units provided herein allow inmates to workout in a controlled exercise area in order to keep them safe from overly aggressive inmates. In addition, the incarceration units provided herein allow inmates, to use items such as a shower, telephone, and television monitor under the control of the management without the need to group inmates together for the use of such items. Accordingly, this system allows inmates to have more freedom while preventing violence that may ensue in traditional exercise yards, bathing facilities, and group settings. Under the present incarceration facility, inmates would only exit their cell for court, visitors, or for medical reasons. A further advantage of the present invention is that the cost of building the incarceration facility would be reduced as well as the amount of space and materials needed for production. In addition, an advantage of the present invention is that fewer guards, building materials, and acreage may be used by the incarceration facility.

It is an advantage of the invention that incarceration management will have control of a door, through a door control means, by which to allow inmates to have access to exercise equipment during specified hours. It is a further advantage of the invention that there is placed one or more windows in the exercise room that allow neighboring inmates to socialize with one another or view the outdoors without the need to group inmates together. There is also a shower built into an inmate's interior cell that is controlled by the incarceration management through a shower control device, such that it may be used only during certain hours of the day, subject to exclusive incarceration management control. In addition, there is a television monitor placed into an inmate's interior cell, the use of which is controlled by the incarceration management through a television monitor control device, subject to exclusive incarceration management control, allowing the inmate to watch television programs that are selected by the incarceration management, such as classroom instruction, religious programs, or news, if allowed. Further, there is a telephone jack built into an inmate's interior cell, wherein an inmate may request the use of a telephone during certain hours, while his/her telephone calls are monitored. Of course, the use of the telephone jack is exclusively controlled by the incarceration management through a telephone jack control device.

In addition, it is an advantage of the present invention that unruly inmates may be placed in solitary cells or specialty cells which could be built into the interior of the incarceration facility above the first floor of the incarceration facility for extra monitoring purposes. A further advantage of the present invention is that both men and women may share different floors of the same building. Most of the floors of the present invention would be "maximum" security. Some of the floors of the present invention would be "medium" security. Further, it is an advantage of the present invention that the "medium" security inmates could provide services to the incarceration units, if permitted by the incarceration management, such services including for example, dropping off meals, library books and laundry, which would also provide rehabilitation to the "medium" security inmates. This provision of service by the inmates would allow for social interaction by the inmates as well as for work-related training in order to assist inmates in rehabilitation and release to society upon expulsion from the incarceration facility. The exact dimensions and items located in each incarceration unit may be determined by individual facilities.

SUMMARY OF THE INVENTION

Described herein are preferred embodiments of the prison reform system which allows for greater security from escape and safety of the inmates. An incarceration unit defines an interior cell and a exercise area. The interior cell further has a door for access to the exercise area, two hi/low beds, a desk, shelving units, toilet, sink, television monitor, telephone jack, and shower. The exercise area has at least one window, a chin-up bar, and at least one exercise equipment. Generally, an inmate is housed in the incarceration unit and is specifically initially housed in the primary interior cell. While in the primary interior cell, the inmate may use at his or her will, two hi/low beds, desk, shelving units, toilet, and sink. In addition, while in the interior cell, the inmate may use, subject to control by the incarceration management through control devices, and upon terms of use set by the incarceration management, television monitor, telephone jack, and shower. Upon approval by the incarceration management, and through an entry control device, an inmate is released from the interior cell into the exercise area in order to allow the inmate to exercise, by opening door. Once released into the exercise area, the inmate may exercise for the time allotted by the incarceration management using the exercise equipment. In addition, once released into the exercise area, the inmate may utilize one or more windows, thereby socializing with other inmates or viewing the outdoors while in the exercise area.

DRAWINGS

FIG. 4 shows a top-down view of a plurality of incarceration units of the second preferred embodiment.

DETAILED DESCRIPTION OF THE PREFERRED EMBODIMENT

Figure 1:
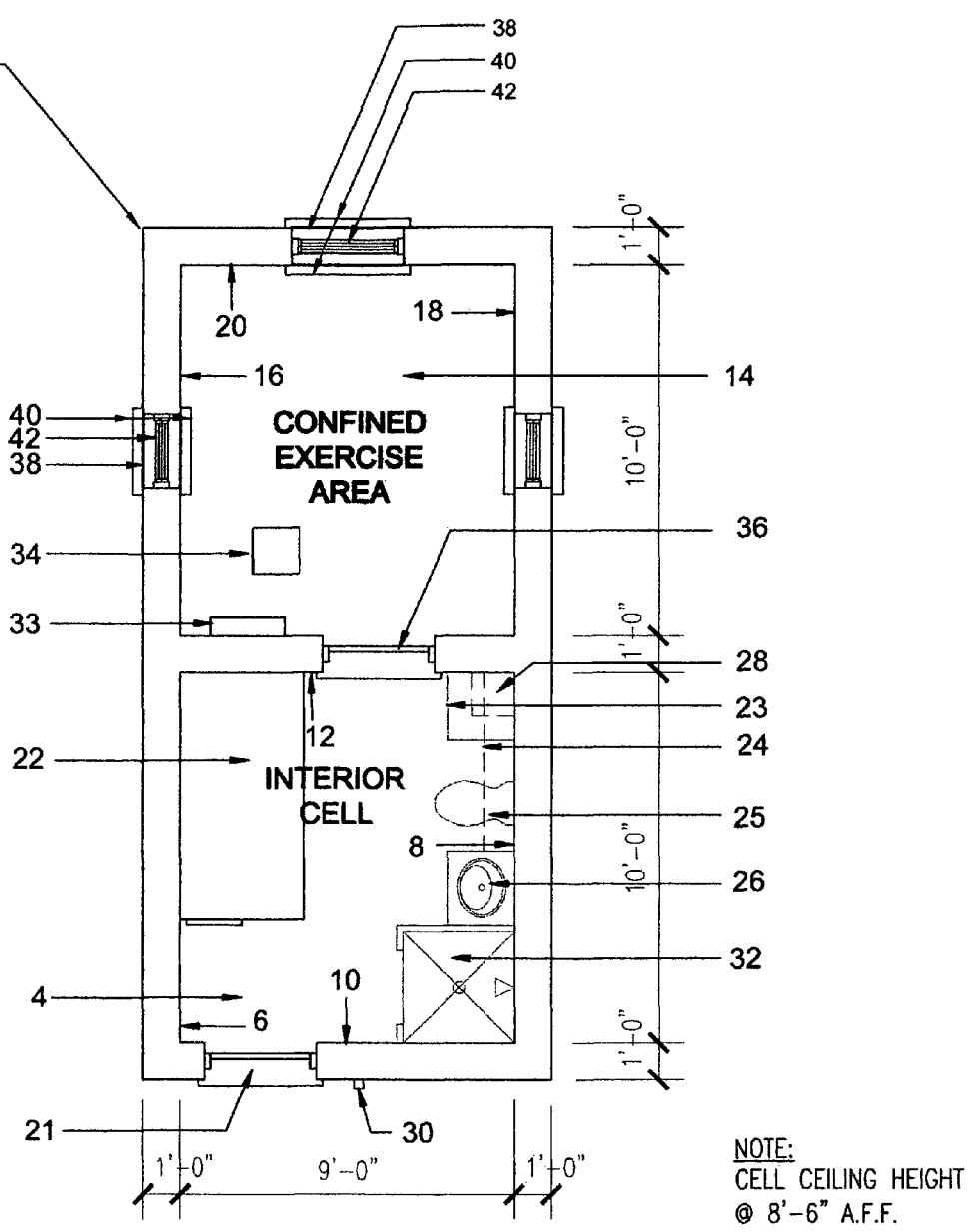
FIG. 1 shows a top-down view of a single incarceration unit of a plurality of incarceration units of the first preferred embodiment.

A first preferred embodiment of the prison reform system which allows for greater security from escape and safety of the inmates is described herein. Referring now to FIG. 1, it is generally designated a "maximum" security incarceration unit (2), a plurality of which embody the present invention. The incarceration unit (2) generally defines a primary interior cell (4), bounded by a first wall (6), a second wall (8), a third wall (10), and a fourth wall (12). In addition the incarceration unit (2) generally defines a secondary confined exercise area (14) that is contiguous with the primary interior cell (4) and that is bounded by the fourth wall (12), a fifth wall (16), a sixth wall (18) and a perimeter wall (20). Thus, the fourth wall (12) is common between, and is located in between, the primary interior cell (4) and the secondary confined exercise area (14). A door (21) is provided upon the third wall (10) allowing the inmate to enter the primary interior cell (4). The primary interior cell (4) comprises two hi/low beds (22), a desk (23), shelving units (24), toilet (25), sink (26), television monitor (28), telephone jack (30) and shower (32). The secondary confined exercise area (14) generally comprises a chin-up bar (33), and exercise equipment (34). The primary interior cell (4) and the secondary confined exercise area (14) are interconnected by a door (36). Upon any of the fifth wall (16), sixth wall (18), or perimeter wall (20) of the secondary confined exercise area (14) may be defined one or more windows (38). Specifically, the one or more windows (38) are generally constructed with a grating material (40) on each side of each of the one or more windows (38). Such placement of grating material (40) prevents the contact of one inmate from another. Specifically, such placement of grating material (40) prevents inmates from touching each other or from passing any items to each other. In addition, one or more bars (39) are generally built within each of the one or more windows (38) such that an inmate may not travel through the window in the event that the grating material (40) was removed. In the first preferred embodiment, the one or more windows (38) may be placed upon the fifth wall (16) or a sixth wall (18) of the secondary confined exercise area (14), thereby allowing inmates to speak with each other while in the secondary confined exercise area (14). In addition, in the first embodiment, the one or more windows (38) may be placed upon the perimeter wall (20), thereby allowing an inmate to view the outdoors while in the secondary confined exercise area (14).

Figure 2:
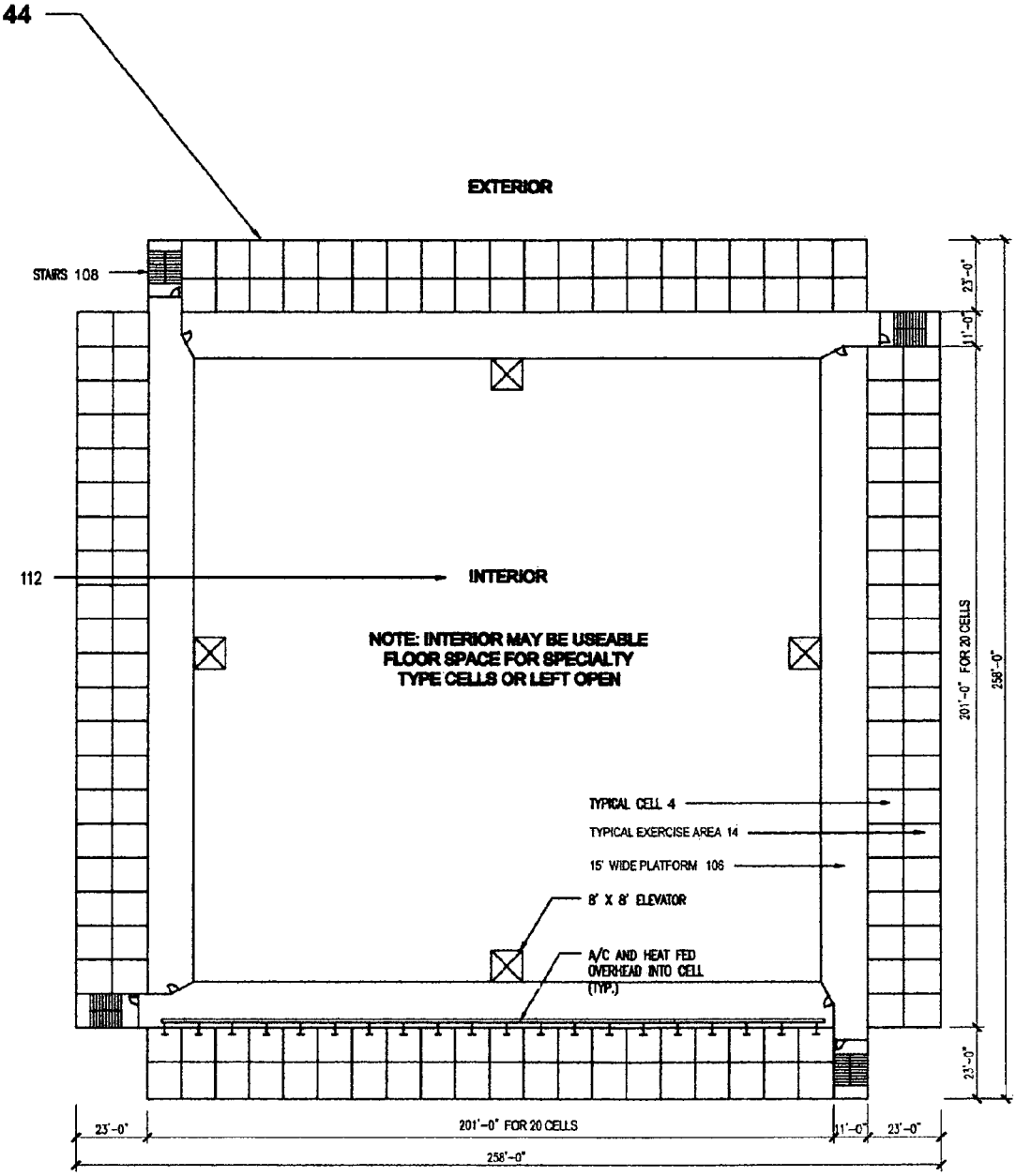
FIG. 2 shows a top-down view of a plurality of incarceration units of the first preferred embodiment.

In operation of the first embodiment, still referring to FIG. 1, the incarceration management allows an inmate that is housed in the incarceration unit (2), and that is specifically initially housed in the primary interior cell (4) to use, upon terms of use set by the incarceration management, a television monitor (28), a telephone jack (30), and a shower (32). Each of the television monitor (28), telephone jack (30), and shower (32), are controlled by the incarceration management through a respective control device. In addition, the incarceration management, via a control device, may allow an inmate that is housed in the incarceration unit (2), and that is specifically initially housed in the primary interior cell (4) to use, upon terms of use set by the incarceration management, a door (36), allowing the inmate to be released into the secondary confined exercise area (14) in order to allow the inmate to exercise. More specifically, incarceration management, via the control device of the door (36), allows the door (36) to open between the primary interior cell (4) and the secondary confined exercise area (14), allowing the inmate to enter the secondary confined exercise area (14) and to utilize the chin-up bar (33) and the exercise equipment (34). Once released into the secondary confined exercise area (14), the inmate may exercise for the time allotted by the incarceration management using the chin-up bar (33) and exercise equipment (34). Further, the inmate may use the one or more windows (38) within the secondary confined exercise area (14). Referring now to FIG. 2, it is reiterated that the incarceration management, through the control device of the door (36), controls the inmates' access to the secondary confined exercise area (14) from the primary interior cell (4). Thus, the incarceration management may decide to allow certain inmates or all of the inmates access to the secondary confined exercise area (14), at the same time or at different times, from the respective primary interior cells (4). In addition, the incarceration management, via the control device of door (36) could decide for example, to allow an inmate access to the secondary confined exercise area (14) from 8:00 am to 8:00 pm, wherein the inmate could intermittently return to his or her primary interior cell (4) to have a delivered meal, take a shower, or utilize one or more of the windows (38). In times of inclement weather, a perforated hard plastic material may be placed over any one of the one or more windows (38) which are located upon the perimeter wall (20), in order to prevent the secondary confined exercise area (14) from incurring rain water or snow.

Figure 3:
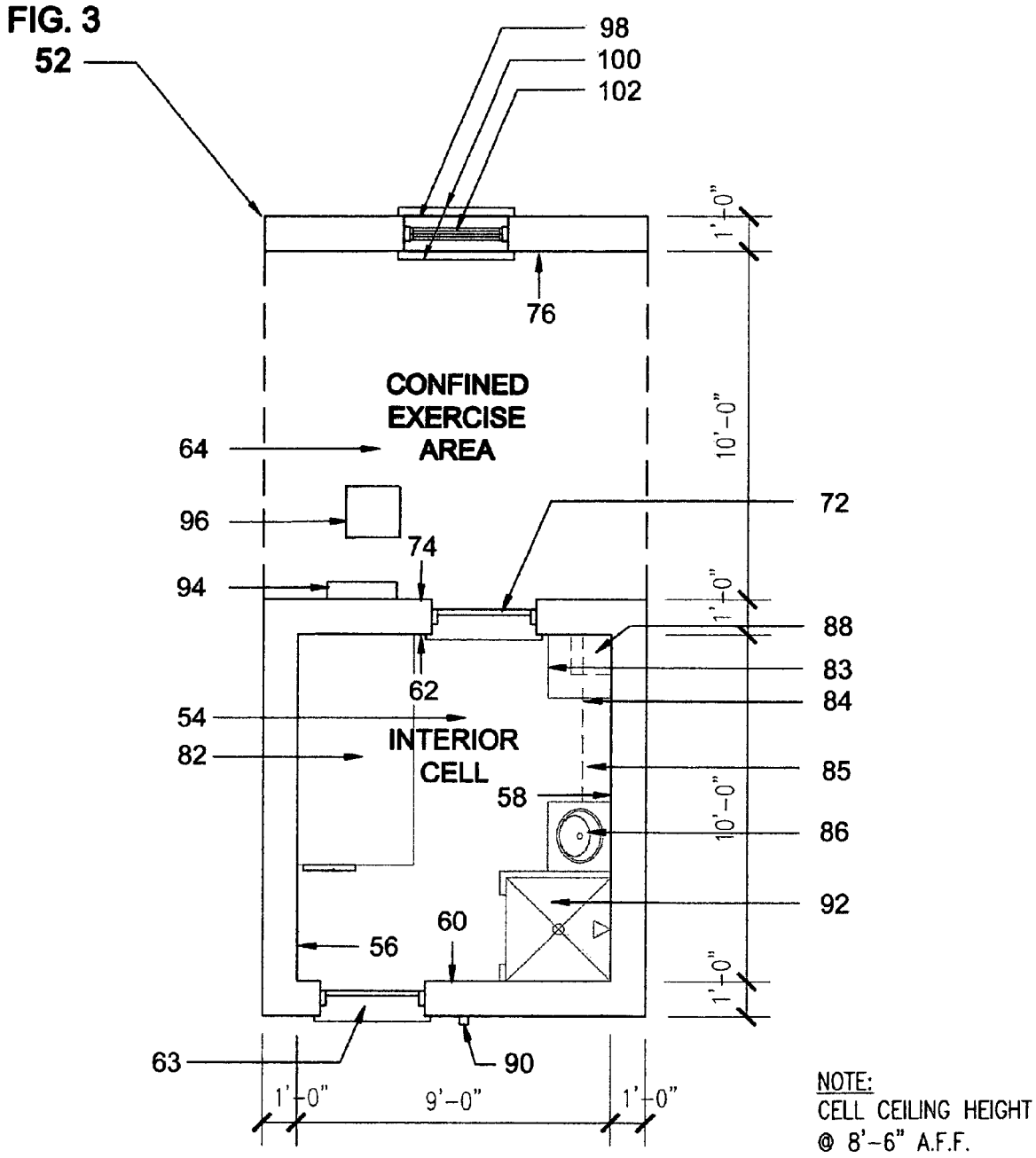
FIG. 3 shows a top-down view of a single incarceration unit of a plurality of incarceration units of the second preferred embodiment.

A second preferred embodiment of the prison reform system which allows for greater security from escape and safety of the inmates is described herein. Referring now to FIG. 3, it is generally designated a "medium" security incarceration unit (52), a plurality of which embody the present invention. The incarceration unit (52) generally defines a primary interior cell (54), bounded by a first wall (56), a second wall (58), a third wall (60), and a fourth wall (62). A door (63) is provided upon the third wall (60) allowing the inmate to enter the primary interior cell (54). In addition the incarceration unit (52) generally defines a secondary exercise area (64). The primary interior cell (54) and the secondary exercise area (64) are interconnected by a door (72). Referring now to FIG. 4, the secondary exercise area (64) is adjacent to the primary interior cell (54), and is bounded by an aggregate wall (74), a perimeter wall (76), a first side end wall (78) and a second side end wall (80). Again referring to FIG. 3, the aggregate wall (74) is formed by a plurality of the fourth walls (62) of a plurality of said incarceration units (52) placed side-by-side. Thus, the aggregate wall (74) is common between, and is located in between, the plurality of primary interior cells (54) and the secondary exercise area (64). As such, in the second preferred embodiment of the invention, there is no "fifth wall" or "sixth wall" as described in the first preferred embodiment. The primary interior cell (54) generally comprises a door (72), two hi/low beds (82), a desk (83), shelving units (84), toilet (85), sink (86), television monitor (88), telephone jack (90) and shower (92). The secondary exercise area (64) generally comprises a chin-up bar (94), and exercise equipment (96). Upon the perimeter wall (76) of the secondary exercise area (64) may be defined one or more windows (98), such that an inmate may view the outdoors while in the secondary exercise area (64). Specifically, the one or more windows (98) are generally constructed with a grating material (100) on each side of the window. Such placement of grating material (100) prevents the contact of an inmate from anything outside of the incarceration facility. In addition, one or more bars (39) are generally built within the one or more windows (98) such that an inmate may not travel through the window in the event that the grating material (100) was removed.

In operation of the second embodiment, still referring to FIG. 3, the incarceration management allows an inmate that is housed in the incarceration unit (52), and that is specifically initially housed in the primary interior cell (54) to use, upon terms of use set by the incarceration management, a television monitor (88), and a telephone jack (90), and a shower (92). Each of the television monitor (88), telephone jack (90), and the shower (92), are controlled by the incarceration management through a respective control device. In addition, the incarceration management, through a control device, may allow an inmate that is housed in the incarceration unit (52), and that is specifically initially housed in the primary interior cell (54) to use, upon terms of use set by the incarceration management, a door (72), allowing the inmate to be released into the secondary exercise area (64) in order to allow the inmate to exercise. Specifically, incarceration management, through the control device of the door (72), allows the door (72) to open between the primary interior cell (54) and the secondary exercise area (64), allowing the inmate to enter the secondary exercise area (64) and to utilize the chin-up bar (94) and the exercise equipment (96). Once released into the secondary exercise area (64), the inmate may exercise in the presence of other inmates and with or without the assistance of other inmates, for the time allotted by the incarceration management using the chin-up bar (94) and exercise equipment (96). Further, the inmate may use the one or more windows (98) within the secondary exercise area (64) to view the outdoors. Referring to FIG. 3 and FIG. 4, it is reiterated that the incarceration management, via a control device of the door (72), controls the inmates' access to the secondary exercise area (64). Accordingly, the incarceration management may decide to allow certain inmates or all of the inmates access to the secondary exercise area (64) at the same time or at different times. In addition, the incarceration management, via the control device of door (72) could decide for example, to allow an inmate access to the secondary exercise area (64) from 8:00 am to 8:00 pm, wherein the inmate could intermittently return to his or her primary interior cell (54) to have a delivered meal, take a shower, or utilize one or more of the windows (98). In times of inclement weather, a perforated hard plastic material may be placed over any one of the one or more windows (98), in order to prevent the secondary exercise area (64) from incurring rain water or snow.

Referring now to FIG. 2, it is generally shown a floor plan of a "maximum" security incarceration facility (44). Specifically, in FIG. 2, it is shown a top-down view of a floor of a "maximum" security incarceration facility (44) comprising a plurality of incarceration units (2) placed in such a manner as to make-up, in part, a floor of the incarceration facility (44). Referring now to FIG. 4 it is generally shown a floor plan of a "medium" security incarceration facility (104). More specifically, in FIG. 4, it is shown a top-down view of a floor of a "medium" incarceration facility (104) comprising a plurality of incarceration units (52) placed in such a manner as to make-up, in part, a floor of the incarceration facility (104). Referring to FIG. 2 and FIG. 4, it is contemplated that an incarceration facility may comprise multiple floors, wherein most floors of the incarceration facility are "maximum" security, being made up of, in part, the plurality of incarceration units (2) as set forth in the first embodiment. Still referring to FIG. 2 and FIG. 4, it is contemplated that an incarceration facility may comprise multiple floors, wherein one or more floors are "medium" security, being made up of, in part, the plurality of incarceration units (52) as set forth in the second embodiment.

In the first embodiment, referring to FIG. 1, the area of either the primary interior cell (4) or the area of the secondary confined exercise area (14) may be changed independent of the other without departing from the scope of the present invention. Referring to FIG. 3, in the first embodiment, the area of either the primary interior cell (54) or the area of the secondary exercise area (64) may be changed independent of the other without departing from the scope of the present invention. In addition, the incarceration units in either of the preferred embodiments in are constructed out of concrete or steel; however, one of ordinary skill in the art would know that similar construction materials may be used without departing from the scope of the present invention. Further, with reference to FIG. 2 and FIG. 4, it is contemplated that the incarceration facility of either preferred embodiment may comprise hallways (106) and stairs (108) that are needed to provide the incarceration units of either preferred embodiment, subject to the discretion of the incarceration management, with such items as meals, library books, and laundry. It is contemplated, with reference to FIG. 1 and FIG. 3 that an incarceration facility may comprise at least one floor of the first embodiment of the present invention and at least one floor of the second embodiment of the present invention; in such situations, a "maximum" security inmate may be moved from a "maximum" security incarceration unit (2) to a "medium" security incarceration unit (52) when he has short time remaining in order to test his ability to refrain from any violence or problematic activities prior to release from the incarceration facility. In addition, in cases where an incarceration facility comprises at least one floor of the first embodiment of the present invention and at least one floor of the second embodiment of the present invention, it is contemplated that items such as meals, library books, and laundry are delivered by well-behaved "medium" security inmates that reside in the a "medium" security floor of the incarceration facility, as a reward for good behavior and for further rehabilitation for work purposes or for socialization purposes. The top down view in FIG. 2 and FIG. 4 shows the interior of the incarceration facility (112). The interior of the incarceration facility (112) may be useable floor space for administrative needs, specialty type cells, or used for other purposes, or just left open. It is specifically contemplated in either FIG. 2 or FIG. 4 that, in either of the preferred embodiments, the ground floor may be used for one or more of the following purposes: reception, administrative offices, guards' room, S.W.A.T. room, infirmary, mechanical room, operations room, storage, or kitchen. In addition, it is specifically contemplated in either FIG. 2 or FIG. 4 that, in either of the preferred embodiments, the floors above the ground floor may be used for one or more of the following purposes: laundry room, library, visiting room, or infirmary. Still referring to FIG. 2 and FIG. 4, the floors above the ground floor are utilized as such, so that an inmate, whether a "maximum" security inmate, or a "medium" security inmate, does not have a need to travel to the ground floor of the incarceration facility, unless the inmate is being released from the incarceration facility. It is further contemplated that elevators may be placed within the incarceration facility in order to make the facility accessible to the handicapped. Upon the roof or exterior of the incarceration facility may be placed a plurality of solar panels in order to collect sunlight energy or a water catchment device in order to supply the facility with fresh rainwater; such placements upon the exterior of the incarceration facility will make the facility more environment friendly or "green."

In describing the incarceration facility and its components, certain terms have been used for understanding, brevity, and clarity. They are primarily used for descriptive purposes and are intended to be used broadly and construed in the same manner. Having now described the invention and its method of use, it should be appreciated that reasonable mechanical and operational equivalents would be apparent to those skilled in the art. Those variations are considered to be within the equivalence of the claims appended to the specification.

I claim:

1. A plurality of incarceration units for detaining inmates in a structure, wherein each of said incarceration units comprises:

(a) a primary interior cell bounded by a first wall, a second wall, a third wall, and a fourth wall, in which an inmate is adapted to be primarily housed, and the first wall is located in the interior of the structure;

(b) a secondary confined exercise area bounded by said fourth wall, a fifth wall, a sixth wall, and a perimeter wall, said secondary confined exercise area is connected to, and contiguous with said primary interior cell, said secondary confined exercise area having at least one exercise equipment therein upon which said inmate may exercise, and the perimeter wall is the outermost wall of the structure;

(c) a first entry device positioned upon said first wall allowing access to said primary interior cell from the interior of the structure; and (d) a second entry device positioned upon said fourth wall between said primary interior cell and said secondary confined exercise area, thereby allowing access to said secondary confined exercise area from said primary interior cell.

2. The plurality of incarceration units according to claim 1 wherein each of said incarceration units further comprises an entry control device for controlling the use of said second entry device to allow access to said secondary confined exercise area from said primary interior cell for a specific period of time.

3. The plurality of incarceration units according to claim 1 wherein said primary interior cell further comprises a shower and a shower control device for controlling the use of said shower.

4. The plurality of incarceration units according to claim 1 wherein said primary interior cell further comprises a telephone jack and a telephone jack control device for controlling the use of said telephone jack.

5. The plurality of incarceration units according to claim 1 wherein said primary interior cell further comprises a television monitor and a television monitor control device for controlling the use of said television monitor.

6. The plurality of incarceration units according to claim 1 wherein said secondary confined exercise area further defines at least one window upon one of said fifth wall, said sixth wall, and said perimeter wall, said window having a grating material on a first side and a second side of said window.

7. The plurality of incarceration units according to claim 1 wherein said secondary confined exercise area further defines at least one window upon one of said fifth wall, said sixth wall, and said perimeter wall, said window having bars within said window.

8. A plurality of incarceration units for detaining inmates in a structure, wherein each incarceration unit comprises:

(a) a primary interior cell bounded by a first wall, a second wall, a third wall, and a fourth wall, in which an inmate is adapted to be primarily housed, and the first wall is located in an interior of the structure;

(b) a secondary exercise area bounded by an aggregate wall, a perimeter wall of the structure, a first side end wall of the structure, and a second side end wall of the structure; said aggregate wall formed by a plurality of said fourth walls of a plurality of said primary interior cells placed side-by-side; said secondary exercise area is adjacent to said plurality of primary interior cells; said perimeter wall positioned opposite of said aggregate wall and said perimeter wall being the outermost wall of the structure, and said secondary exercise area further comprises at least one exercise equipment therein upon-which said inmate may exercise; and (c) a first entry device positioned upon said first wall allowing access to said primary interior cell from the interior of the structure; and (d) a second entry device positioned upon said fourth wall between said primary interior cell and said secondary exercise area, thereby allowing access to said secondary exercise area from said primary interior cell.

9. The plurality of incarceration units according to claim 8 wherein each of said incarceration units further comprises an entry control device for controlling the use of said second entry device to allow access to said secondary exercise area from said primary interior cell for a specific period of time.

10. The plurality of incarceration units according to claim 8 wherein said primary interior cell further comprises a shower and a, shower control device for controlling the use of said shower.

11. The plurality of incarceration units according to claim 8 wherein said primary interior cell further comprises a telephone jack and a telephone jack control device for controlling the use of said telephone jack.

12. The plurality of incarceration units unit according to claim 8 wherein said primary interior cell further comprises a television monitor and a television monitor control device for controlling the use of said television monitor.

13. The plurality of incarceration units unit according to claim 8 wherein said secondary exercise area further defines at least one window upon said perimeter wall, said window having a grating material on a first side and second side of said window.

14. The plurality of incarceration units according to claim 8 wherein said secondary exercise area further defines at least one window upon said perimeter wall, said window having bars within said window.

15. A method for providing a structure having a plurality of incarceration units for detaining inmates, wherein the method comprises the steps of:

(a) forming a primary interior cell bounded by a first wall, a second wall, a third wall, and a fourth wall, in which an inmate is adapted to be primarily housed, wherein the first wall is located in the interior of the structure;

(b) forming a secondary confined exercise area bounded by said fourth wall, a fifth wall, a sixth wall, and a perimeter wall; wherein said secondary confined exercise area is connected to, and contiguous with said primary interior cell, and the perimeter wall is the outermost wall of the structure;

(c) providing a first entry device positioned upon said first wall allowing access to said primary interior cell from the interior of the structure; and (d) providing a second entry device positioned upon said fourth wall between said primary interior cell and said secondary confined exercise area, thereby allowing access to said secondary confined exercise area from said primary interior cell.

16. The method according to claim 15, further comprising providing an entry control means for controlling the use of said entry device.

17. The method according to claim 15, further comprising the step of providing a shower, and a shower control device for controlling the use of said shower in the primary interior cell.

18. The method according to claim 15, further comprising the step of providing a telephone jack and a telephone jack control device for controlling the use of said telephone jack in the primary interior cell.

19. The method according to claim 15, further comprising the step of providing a television monitor and a television monitor control device for controlling the use of said television monitor in the primary interior cell.

20. The method according to claim 15, further comprising the step of defining a window having a grating material on a first side and second side of said window, and the step of providing bars within said window.

* * * * *